United States Patent [19]

Thornborrow et al.

[11] Patent Number: 4,905,553

[45] Date of Patent: Mar. 6, 1990

[54] TUBE WORKING APPARATUS

[75] Inventors: John W. T. K. Thornborrow, Sonning; John Deacon, Bodmin, both of England

[73] Assignee: J R Group PLC, Reading, England

[21] Appl. No.: 190,084

[22] Filed: May 4, 1988

[51] Int. Cl.[4] ..... B21D 28/28

[52] U.S. Cl. ..... 83/193; 83/178; 83/277; 83/414

[58] Field of Search ..... 83/54, 180, 188, 191, 83/192, 193, 277, 414, 437, 206, 178

[56] References Cited

U.S. PATENT DOCUMENTS

| | | | |
|---|---|---|---|
| 402,273 | 4/1889 | Olmsted | 83/180 |
| 1,963,768 | 6/1934 | West | 83/414 |
| 2,326,536 | 8/1943 | Hartstock et al. | 83/193 |
| 3,489,045 | 1/1970 | Ray, Sr. | 83/188 |
| 4,426,899 | 1/1984 | Long et al. | 83/188 |

FOREIGN PATENT DOCUMENTS

| | | | |
|---|---|---|---|
| 229178 | 10/1959 | Australia | 83/180 |
| 1037191 | 7/1966 | United Kingdom . | |
| 1162355 | 8/1969 | United Kingdom . | |
| 1312454 | 4/1973 | United Kingdom . | |
| 1548781 | 7/1979 | United Kingdom . | |
| 2024690 | 1/1980 | United Kingdom . | |
| 1583948 | 2/1981 | United Kingdom . | |

*Primary Examiner*—Hien H. Phan

*Attorney, Agent, or Firm*—Finnegan, Henderson, Farabow, Garrett & Dunner

[57] ABSTRACT

Tube working apparatus is provided comprising a mandrel having a die thereon over which a tube to be worked can be positioned. The die is adapted to cooperate with a tool externally of the tube to work the tube. Feed means is provided for effecting relative movement between the mandrel and the tube whereby the tube is progressively withdrawn from the mandrel as working proceeds.

9 Claims, 3 Drawing Sheets

TUBE WORKING APPARATUS

This invention relates to an apparatus and method for working a tube, and particularly, although not exclusively, to forming one or more longitudinally extending rows of apertures in a long metal tube by punching or the like, and to feed apparatus for feeding a tube relative to a tool for working the tube.

Tubes with longitudinally extending rows of apertures formed therein are used in a wide variety of applications, and metal tubes in particular are widely used in support frameworks for storing and displaying goods. Such metal tubes, when formed with apertures or slots along their length allow the formation of an extremely robust and versatile framework of any given dimensions whereby the apertures may be utilised for the insertion of end portions of further framework members to brace and/or extend the framework. Whether the tube be round, square, rectangular or otherwise it is common for several longitudinally extending rows of spaced apertures to be angularly spaced around the tube to provide versatility for use in a framework whereby further framework members may be engaged with the tube from varying angles.

When the tube is made of metal, although it may be of any suitable material, e.g., plastics material, it is usual to form the apertures therein by punching or the like using a mandrel comprising a die which is advanced through the tube as aperture forming proceeds and which cooperates with a punching tool which is forced through the tube so that it enters one side thereof and exits from the opposite side thereof to form apertures in opposite sides of the tube. The blanks cut from the tube when the apertures are formed on the entry side are deposited within the tube and build up in front of the mandrel as the mandrel is advanced through the tube where they frequently interfere with the advance of the mandrel through the tube. As the number of blanks which can be accommodated during aperture forming for a given length of tube is limited, it has hitherto been difficult to form more than two rows of apertures in a tube at a single pass, and this has meant that two or more passes have been necessary to form four or more rows of apertures in a single tube, with concomitant problems of interim tube straightening between passes arising. Problems also occur in conventional tube working due to the fact that the previously formed apertures are used to locate the tube relative to the tool when the next apertures are to be formed. This leads to compound errors of location because of the multiple engagement of the tube during feeding, whereby the tube will be released after each working and re-engaged using the just formed apertures as a datum. Hence it is common for the rows of apertures to "spiral" round a tube or for the spaces between the apertures to be stretched or shortened by such compound errors building up as working progresses. Furthermore, burrs are formed around the apertures on the exit side and these burrs have to be removed. Thus, to form four rows of apertures spaced at 90° to one another in a single tube six operations are required, namely two punching operations, two tube straightening operations and two de-burr operations, which is both time consuming and costly.

It is an object of the present invention to provide apparatus and a method for forming apertures in a tube which overcomes or mitigates some or all of the aforesaid difficulties.

According to the present invention there is provided tube working apparatus comprising a mandrel having a die thereon over which a tube to be worked can be positioned, at least one tool externally of the tube and adapted to cooperate with said die to work the tube, and feed means for progressively withdrawing the tube from the mandrel as working proceeds, said feed means comprising means for non-releasably engaging the tube throughout working thereof and means for intermittently moving the tube engaging means, and hence the tube, by predetermined amounts.

The present invention also provides a method of working a tube comprising the steps of positioning a tube to be worked over a mandrel having a die thereon, operating at least one tool externally of the tube in cooperation with said die to work the tube, and effecting relative movement between the tube and mandrel to progressively withdraw the tube from the mandrel as working proceeds.

Working of the tube preferably comprises forming rows of spaced apertures therein, although other types of working, for example pressing or machining, are also included. When forming apertures in the tube the blanks produced as the apertures are formed will collect in the interior of the tube. However, because the tube is withdrawn from the mandrel as aperture forming progresses, the blanks cut from the tube wall and collecting in the tube will be carried away from the mandrel and die, so avoiding the blanks building-up in front of the die and mandrel as was previously the case.

The present invention also aims to provide feed means for the apparatus of the invention which avoids the compound errors of the prior known apparatus.

Thus according to a further aspect thereof the present invention provides means for feeding a tube relative to at least one tool comprising tube engaging means, locating means arranged parallel to the path of travel of the tube and providing a series of spaced locations along the length thereof, and advancing means for advancing the tube engaging means one location at a time, whereby to feed the tube intermittently by predetermined amounts.

Preferably the feed means of the tube working apparatus of the present invention is the feed means according to the said further aspect of the invention.

Said locating means may comprise a toothed rack the teeth of which provide said series of spaced locations. Generally the rack teeth will be equally spaced from one another to provide apertures in a tube being worked which are at a constant distance from one another, although it will be understood that if desired the rack teeth can be variably spaced to provide apertures in a tube at varying distances from one another. The toothed rack may be interchangeable with one or more other toothed racks the teeth of which are differently spaced to enable apertures with different spacings therebetween to be formed in tubes to be worked.

The tube engaging means may comprise chuck or like means for gripping or clamping a tube to be worked, e.g., at one end thereof. The tube engaging means is preferably adapted to constantly engage a tube throughout the working of the tube.

The advancing means may comprise a carriage on which said tube engaging means is mounted and which is movable along said rack, pawl means whereby said carriage can be moved along said rack one tooth at a time, and means for moving the carriage along said rack. The moving means may comprise pneumatic or hydraulic piston-and-cylinder means or other suitable means.

The said mandrel may be mounted substantially parallel with said rack and may extend through said tube engaging means. Thus the tube engaging means will travel along the mandrel as said carriage is moved along the rack and will provide intermediate support for the mandrel. Preferably the mandrel is supported at one end and said die is provided at the other end thereof. The mandrel is of a length sufficient to receive thereover the whole of that portion of a tube which is to be worked.

A toolhead may be provided at the location of said die and may support one or more tools for radial movement relative to said die and a tube to be worked. Said toolhead may define with said die an annular opening through which a tube to be worked can pass. Thus the toolhead and the tube being worked serve to support that end of the mandrel which carries said die.

The said toolhead preferably comprises an even number of tools which are arranged in one or more pairs on diametrically opposed sides of a tube to be worked so that each pair cooperates with said die to simultaneously produce apertures in diametrically opposed sides of the tube. This avoids problems of the tube bending as apertures are produced therein and so avoids the need for any subsequent straightening of the tube. Preferably the toolhead comprises two tools arranged at 180° to one another or tour tools arranged at 90° to one another.

To assist in removing the blanks which are formed as the apertures are produced and which collect in the interior of the tube being worked from the vicinity of said die, said mandrel may be hollow and compressed air or other gas under pressure may be blown through the mandrel and through suitable passages in the die.

The at least one tool may comprise a punch type tool for punching and/or breaking and/or shearing the wall or walls of the tube in co-operation with the die. For elongate apertures, for example slots, a cutting edge of the tool may be angled so as to engage a wall of the tube progressively upon impact therewith; such angling of the tool may be effected on a longer cutting edge thereof for cleaner formation of the aperture. Clearance between the die and the tube may be fairly large according to this invention, particularly when the apertures formed comprise elongate slots with their longer sides parallel to the axis of the tube. In these circumstances axial location of the die within the tube may be more critical than radial location, and a substantial clearance to allow for commonly found commercial burrs etc. on the inner wall of the tube may be allowed.

The present invention will now be more particularly described with reference to the accompanying drawings, in which.

Figure 1:
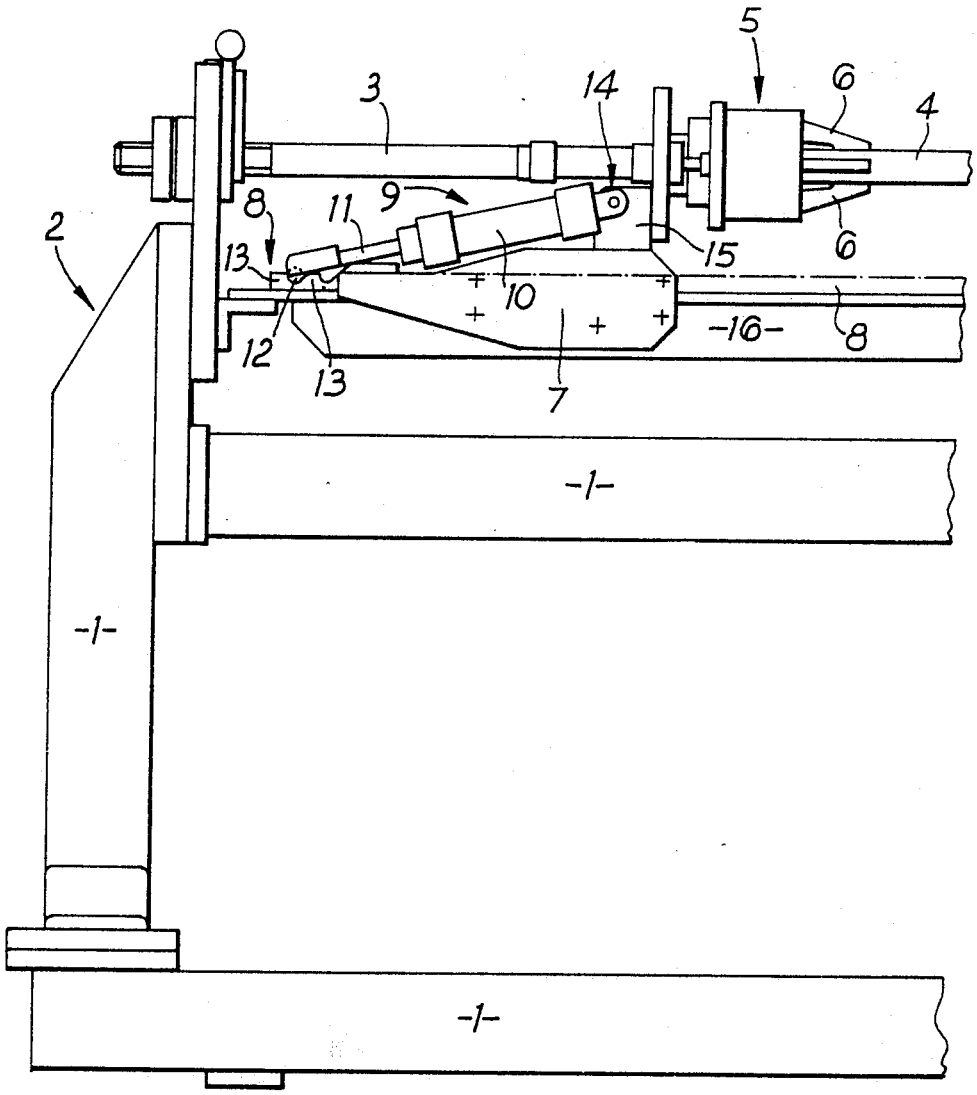
FIG. 1 is a side view of a first end of apparatus according to this invention.
Figure 2:
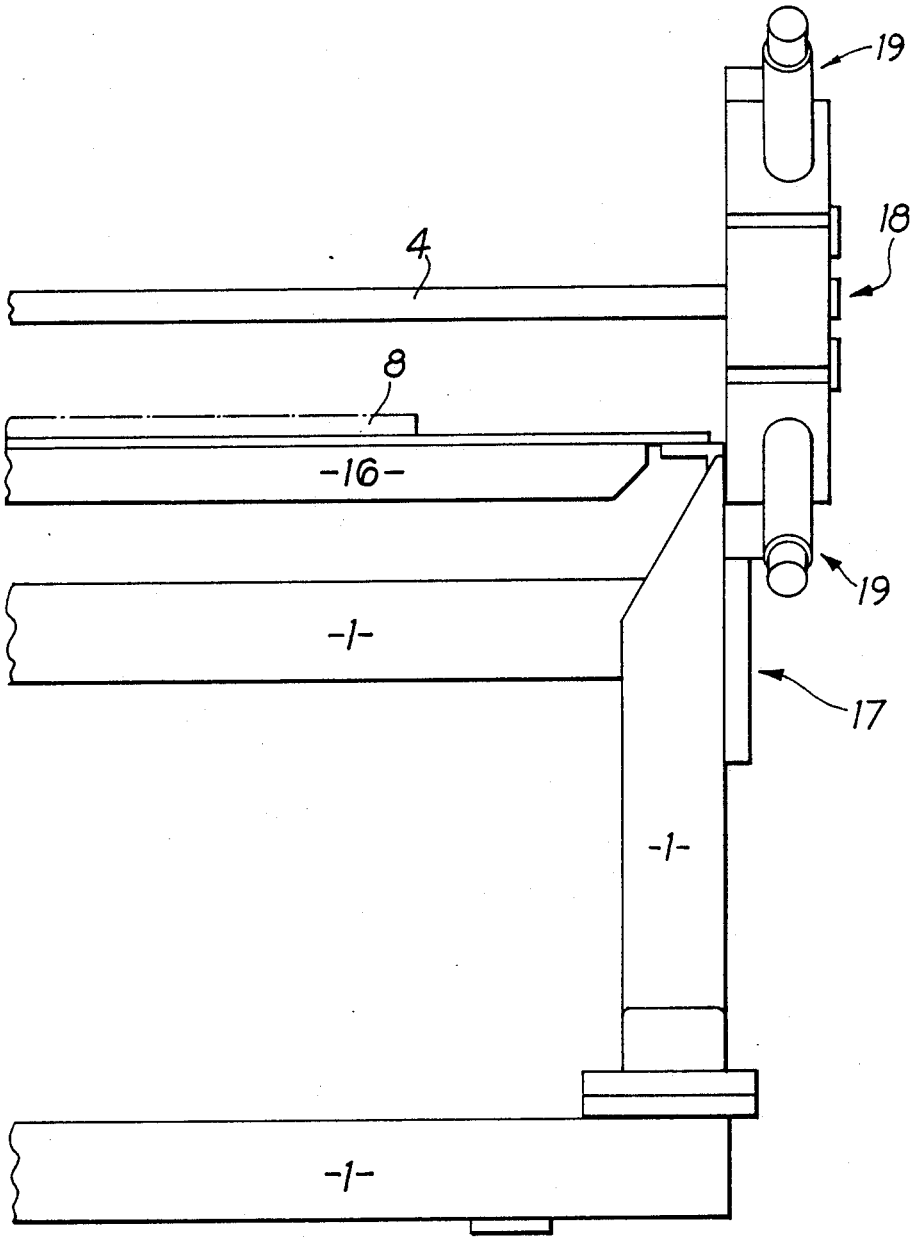
FIG. 2 is a side view of the other end of the apparatus of FIG. 1.

Referring to FIGS. 1 and 2, the apparatus illustrated comprises a bed 1 supporting, at a first end 2 thereof, one end of a mandrel 3, the mandrel 3 extending through a tube 4 to be worked and through tube engaging means comprising a chuck 5 having jaws 6, adapted to firmly grip one end of the tube 4. The chuck 5 is mounted on a carriage 7 which is movable along a toothed rack 8 extending substantially parallel to the mandrel 3. The carriage 7 has wheels (not shown) which engage tracks provided by the toothed rack 8 and also comprises braking means (not shown) which cooperates with a surface 16 of the rack 8 to provide braking when required. The carriage 7 is movable along the rack 8 by pneumatic piston-and-cylinder means 9 having a cylinder 10, a piston (not shown) mounted on one end of a piston rod 11 and a pawl in the form of a roller 12 mounted on the other end of the piston rod 11. The roller 12 is in engagement with one of a series of teeth 13 on the rack 8. The cylinder 10 comprises a pivot 14 by which the piston-and-cylinder means 9 is mounted pivotally to a body 15 of the carriage 7. The carriage 7 is movable along the rack 8 by one rack tooth 13 at a time by retracting the piston rod 11 whilst said braking means is engaged so that the roller 12 rides over and engages the next tooth 13 of the rack 8 and then extending the piston rod 11 with said braking means released to move the carriage 7 by the distance of one tooth 13.

At the other end 17 of the bed 1 is a tool head 18 carrying tour radially movable tools 19 which are equally spaced around an aperture in the tool head 18 adapted to receive the tube 4.

Figure 3:
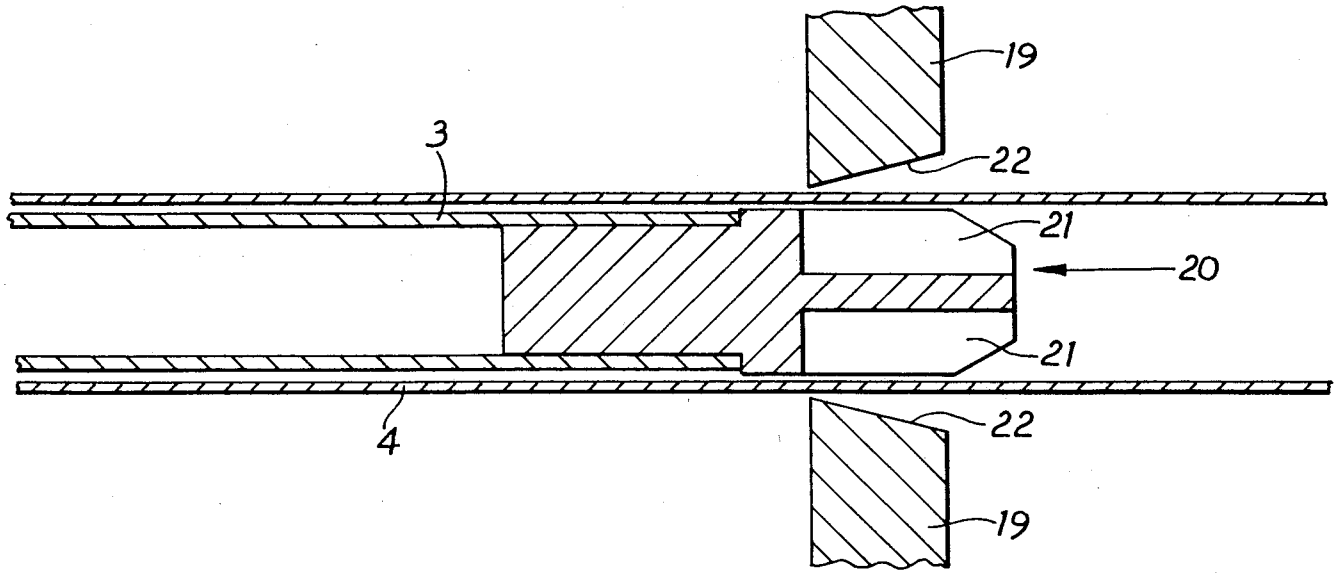
FIG. 3 is a fragmentary axial section on a larger scale through a tube, mandrel and tools of the apparatus of FIGS., 1 and 2.

Referring now to FIG. 3, the mandrel 3 has a die 20 mounted on that end thereof adjacent the tool head 18, the die 20 being adapted to cooperate with the tools 19 to form apertures in the wall of the tube 4. The mandrel 3 and the die 20 extend within the tube 4, and externally of the tube 4 are positioned the tools 19. The die 20 comprises slots 21, each adapted to receive a tool 19 and a blank (not shown) removed from the wall of the tube 4 upon the tool 19 being forced through the wall of the tube. Each tool 19 has an angled cutting edge 22 formed thereon to form slots in the wall of the tube 4 by a combined punching and shearing action.

In operation, the tube engaging means is positioned at the first end 2 of the bed 1 with the jaws 6 of the chuck 5 open, the piston rod 11 extended and said braking means engaged. A tube 4 is then inserted through the tool head 18 and threaded over the die 20 and mandrel 3 into the jaws of the chuck 5. The jaws 6 are now tightly closed on the tube 4 and will remain so until aperture forming in the tube 4 is completed. As many tools 19 as required are now operated to form apertures in the wall of the tube 4 in the manner aforesaid. When the apertures have been formed and the tools 19 withdrawn the tube 4 is advanced by the distance of one tooth 13 on the rack 8 by moving the carriage 7 as hereinbefore described and the tools 19 operated to form further apertures in the wall of the tube 4. These operations are repeated until the required number of apertures have been formed in the tube 4. As aperture forming proceeds along the length of the tube 4 so the tube 4 is intermittently and progressively withdrawn from the mandrel 3.

Upon completion of aperture forming, the jaws 6 of the chuck 5 are opened and the tube 4 is fully withdrawn from the apparatus, whereupon the blanks inside the tube 4 may simply be emptied out. After removal of the tube 4 the carriage 7 is returned to its starting position ready to begin working on a new tube 4.

The mandrel 3 is hollow and, although not shown in the drawings, the interior thereof is connected to a source of compressed air whereby air under pressure can be blown through the mandrel 3 and through passages (not shown) in the die 20 communicating the interior of the mandrel 3 with the slots 21 in the die to remove the blanks produced during aperture forming from the vicinity of the die 20.

We claim:

1. Tube working apparatus comprising a mandrel fixedly mounted at one end to a bed of the apparatus and having a die thereon at the other end thereof, the mandrel being of a length to receive thereover the whole of that portion of a tube which is to be worked, at least one tool externally of the tube and adapted to cooperate with said die to work the tube by removing blanks from a wall thereof to form apertures therein, and feed means for moving the tube to be worked relative to said die and said at least one tool, said feed means comprising tube engaging means for nonreleasably engaging the tube throughout the working thereof and means for intermittently moving the tube engaging means and the tube received over said mandrel by predetermined amounts in a direction to progressively withdraw the tube from the mandrel as working proceeds, whereby blanks removed from the tube wall and collecting in the tube will be carried by the tube in a direction away from said mandrel and said die, said means for intermittently moving the tube engaging means by predetermined amounts comprising a toothed rack arranged parallel to the path of travel of the tube to be worked, a carriage on which said tube engaging means is mounted, pneumatic or hydraulic piston-and-cylinder means for moving the carriage along said toothed rack and a pawl carried by said piston-and-cylinder means and engageable with teeth of said rack for moving said carriage along said rack one tooth at a time.

2. Tube working apparatus according to claim 1, wherein the teeth of said toothed rack are equally spaced from one another.

3. Tube working apparatus according to claim 1, wherein the toothed rack is interchangeable with at least one other toothed rack the teeth of which are differently spaced.

4. Tube working apparatus according to claim 1, wherein the tube engaging means comprises chuck means for gripping or clamping a tube to be worked.

5. Tube working apparatus according to claim 4, wherein said chuck means is adapted to engage the tube at one end thereof.

6. Tube working apparatus according to claim 1, wherein said mandrel is mounted substantially parallel with said rack and extends through said tube engaging means, whereby the tube engaging means travels along the mandrel as said carriage is moved along the rack and provides intermediate support for the mandrel.

7. Tube working apparatus according to claim 1, comprising a toolhead provided at the location of said die and adapted to support one or more tools for radial movement relative to said die and tube to be worked.

8. Tube working apparatus according to claim 7, wherein said toolhead and said die define between them an annular opening through which a tube to be worked can pass.

9. Tube working apparatus according to claim 7, wherein said toolhead comprises an even number of tools which are arranged in one or more pairs on diametrically opposed sides of a tube to be worked.

* * * * *